United States Patent [19]

Klaus

[11] Patent Number: 4,912,282

[45] Date of Patent: Mar. 27, 1990

[54] PROCESS FOR OPERATING A PLANT FOR THE CRACKING OF HYDROCARBONS

[75] Inventor: Mikulla Klaus, Geretsried, Fed. Rep. of Germany

[73] Assignee: Linde Aktiengesellschaft, Hollriegelskreuth, Fed. Rep. of Germany

[21] Appl. No.: 736,349

[22] Filed: May 21, 1985

Related U.S. Application Data

[63] Continuation of Ser. No. 596,740, Apr. 4, 1984, abandoned.

[51] Int. Cl.[4] ..... C07C 4/04

[52] U.S. Cl. ..... 585/648; 585/649; 585/650; 585/652; 208/106; 208/129; 208/130

[58] Field of Search ..... 208/106, 130, 129; 585/650, 652, 648, 649

[56] References Cited

U.S. PATENT DOCUMENTS

| | | | |
|---|---|---|---|
| 2,632,689 | 3/1953 | Latchum, Jr. | 585/648 |
| 2,660,032 | 11/1953 | Rosenthal | 208/129 |
| 2,870,231 | 1/1959 | Hughes et al. | 585/652 |
| 3,233,005 | 2/1966 | Shannahan et al. | 585/652 |
| 3,329,605 | 7/1967 | Tokuhisa et al. | 208/130 |
| 3,765,167 | 10/1973 | Rudolph et al. | 208/130 |
| 4,287,377 | 9/1981 | Maslin et al. | 585/648 |

*Primary Examiner*—Anthony McFarlane

*Attorney, Agent, or Firm*—James Creighton Wray

[57] ABSTRACT

The invention relates to a process for operation of a plant for the cracking of hydrocarbons. In this process, the hydrocarbons in the cracking furnaces are indirectly heated by the heat incurred in the combustion of a heating medium with an oxygen containing gas. In order to reduce operating costs of such a process, it is suggested to mix the waste gas of a gas turbine with air and to pass the gas mixture to the cacking furnace for combustion of the heating medium whereby an electric generator is powered by the gas turbine.

29 Claims, 1 Drawing Sheet

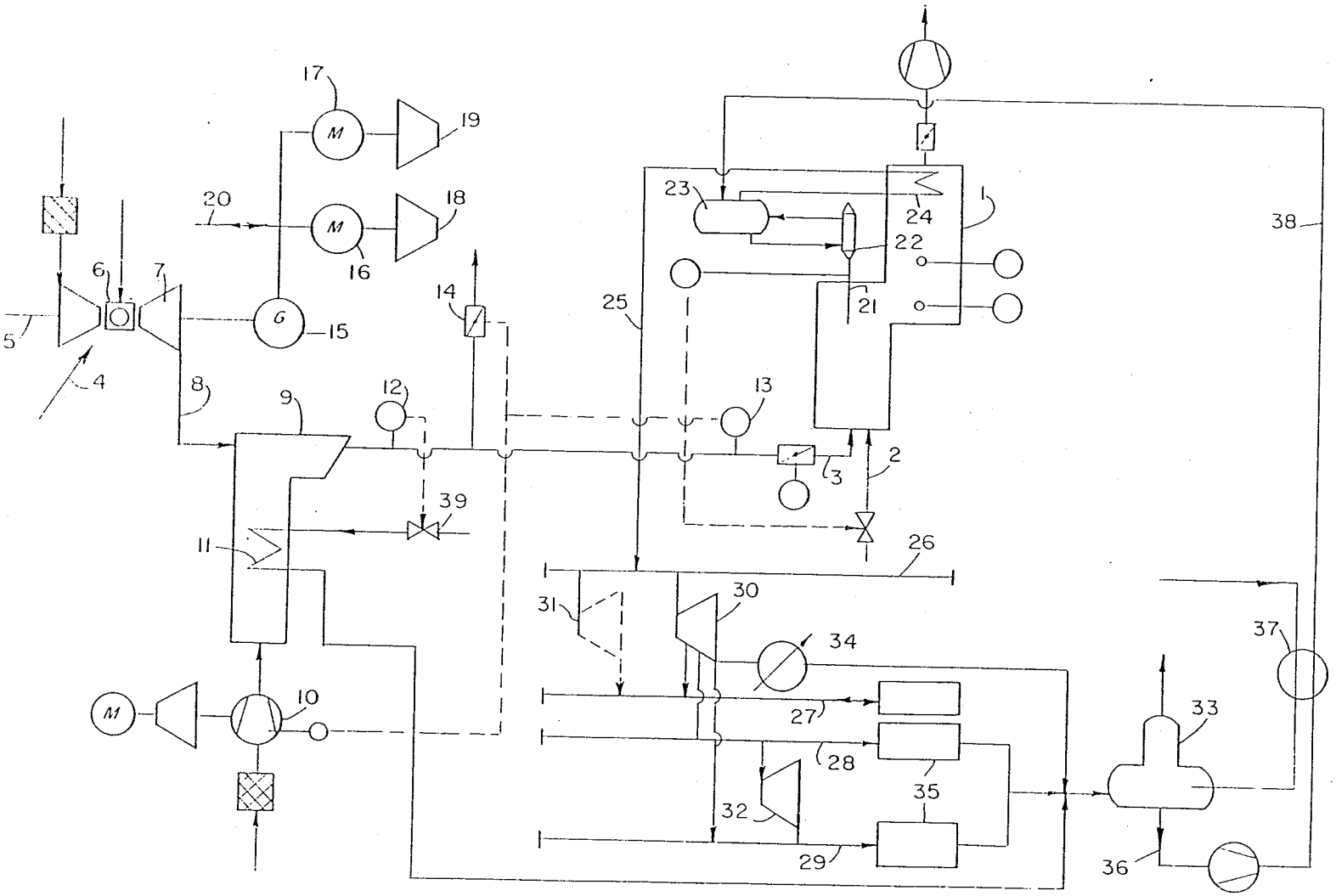
1
2
3
4
5
6
7
8
9
10
11
12
13
14
15
16
17
18
19
20
21
22
23
24
25
26
27
28
29
30
31
32
33
34
35
36
37
38
39
M
G

PROCESS FOR OPERATING A PLANT FOR THE CRACKING OF HYDROCARBONS

This application is a continuation, of application Ser. No. 596,740, filed 4/4/84, now abandoned.

BACKGROUND OF THE INVENTION

The invention relates to a process for operating a plant for the cracking of hydrocarbons, whereby the hydrocarbons are indirectly heated in the cracking furnace by heat incurred in the combustion of a heating medium with oxygen containing gas. More specifically, the invention relates to a process where hydrocarbons are cracked to form olefin-gases, such as ethylene ($C_2H_4$).

It is known in processes for the generation of high-olefinic cracked gases to feed stock, such as naphtha, ethane, to cracking furnaces, whereupon cracked gases leaving the furnaces are cooled and fed to compressors. After compression, the cracked gases are further processed to obtain, for example, ethylene.

SUMMARY OF THE INVENTION

The present invention relates to a process which renders hydrocarbon cracking more economical.

In contrast to the previously known process, cracked gases leaving the furnace are compressed to produce gases high in olefins.

Within a plant for the production of gases high in olefins, many compressors and pumps are used for compressing feed gas, ethylene, and propylene. Conventionally, these compressors are driven by steam turbines.

According to the present invention, a gas turbine and an air preheater are added to increase process efficiency.

In order to produce cracked gases high in olefins in a plant of the kind described above, hydrocarbons are exposed to high temperatures in cracking furnaces. To this end, fuel is subjected to combustion with air in the cracking furnaces. The gas is cooled in quench coolers to maintain reaction equilibrium of the cracked gas at the furnace exhaust. The waste heat of the cracked gases is utilized to generate high pressure steam. Conventionally, the steam thus generated is passed to the steam system consisting of several steam headers. Among other things, the steam is then expanded in steam turbines which drive the main compressors of the plant, as for example, the compressor for crude gas, for the ethylene and for the propylene of the ethylene cycle or propylene cycles, respectively.

As a result of escalating prices for raw materials, operating costs for the processes previously used are very high.

Thus, it is the objective of the invention to introduce a process for operating a plant for the cracking of hydrocarbons which reduces operating costs compared to the process previously used.

This objective is achieved in that the waste gas of a gas turbine is admixed with air, and the gas mixture is passed to the cracking furnace for fuel combustion, whereby the gas turbine drives an electric generator.

It is one of the premises of the inventive process that the waste gas of a gas turbine is available at a high temperature level in comparison with a steam circuit. Utilization of the waste heat of the gas turbine operation greatly improves the total efficiency of the gas turbine process.

On the other hand, selection of a gas turbine is limited by the types offered by suppliers which, at this time, have large jumps in capacity. Adaptation to the output desired, which is available in the case of steam turbines, is not possible. As a result, excess capacity might have to be installed for certain plant sizes, resulting in less advantageous consumption rates due to continuous part load operation.

If speed control of the service turbine is required, the gas turbine must be of a dual shaft design. This type of gas turbine, however, is relatively expensive. In light of the above characteristics of gas turbines, the inventive process offers the following significant advantages.

Due to the preheating of the combustion air for the cracking furnaces, the reuse of gas turbine waste gases and the employment of a gas turbine as a generator drive, a cost reduction in operating olefin plants is achieved, as is further discussed below.

Due to the constant rotational speed in operation, single shaft gas turbines are suitable as a generator drive. Single shaft gas turbines, inclusive of generators, are available as standard components and are essentially lower priced than dual shaft gas turbines for mechanical drives.

The process of the invention uses gas turbines for generating electrical energy. Such energy can, for instance, be utilized within the plant for operating pumps or compressors. Accordingly, the need to install a gas turbine with excess capacity in proportion to plant size is eliminated. Instead, a gas turbine can be selected according to plant size, affording full load operation and thus yielding better consumption rates than a gas turbine with excess capacity for the plant size, operating with only partial loads.

The process of the invention may require that a certain amount of current be imported, which, however will still be less than that required by a plant operating according to the present state of the art. The electrical current to be imported depends upon whether a well-fitted gas turbine can be found for the plant, and upon which mode of drive (steam or electric motors) is selected for the respective plant compressors.

On principle, a failure of a gas turbine does not have an aggravating effect on the plant operation if electrical power can be immediately withdrawn from the net, on a large scale. In such a case, the plant can continue to supply products meeting specifications. Changes in combustion air data have to be detected and balanced by adjustment of the furnace control loops.

In case of a failure by either the cracking furnace or the entire olefin plant, the gas turbine can continue operation. In such a case, the turbine waste gas is passed to a chimney and the electric current generated is exported, if possible.

The process of the invention uses the turbine waste gas which still has a relatively high oxygen content (approximately 16%) as preheated "combustion air" in the cracking furnaces. However, the remaining oxygen, contained in the turbine waste gas, is not sufficient to completely supply all of the furnaces of the olefin plant. The process of the invention, therefore, provides that air is added to the gas turbine waste gas. If the air added to the turbine waste gas has ambient temperature, the relatively high temperature of the waste gas is lowered very much. Unusually high energy losses are incurred. In a preferred embodiment of the inventive process, the air is, therefore, preheated before it is added to the turbine gas. It is particularly beneficial when the air is preheated by heat exchange with steam from the steam system of the plant. Due to the resultant higher theoretical combustion temperature, the effectiveness of the radiation zone is increased so that the fuel requirement for the cracking furnaces is reduced. As a consequence of lower heat supply to the cracking furnaces, the heat potential in the convection zone is reduced and the lower heat supply also reduces steam production of the cracking furnaces. If process pumps and compressors of the plant are not driven by steam turbines but by electric motors, steam export is increased in spite of lower steam production in the process of the invention, as compared to the conventional process.

In another embodiment of the invention, the air added to the waste gas advantageously, is heated to a temperature compensating for temperature fluctuations of the gas turbine waste gas. In this manner, the temperature of the gas mixture consisting of gas turbine waste gas and air is always kept at a constant level. Adverse effects caused by temperature fluctuations of the gas turbine waste gas in operation of the furnace are avoided.

In still another feature of the invention, the air added to the waste gas of the gas turbine is in an amount which compensates for fluctuations in the waste gas quantity. This feature is particularly significant if there is gas turbine breakdown as the cracking furnaces are then supplied with outside air, entirely. In normal operation, the temperature of the turbine waste gas is, for example, approximately 550° C. The air added is preheated to 200° C., for example, in order to attain a temperature of 400° C. for the mixture. The air preheater is appropriately designed for normal operating conditions and is therefore capable of heating the total air quantity to approximately 100° C. in the event of gas turbine failure. This means that the changes at the cracking furnaces regarding radiation zone effectiveness, and, inherently, fuel requirements and steam production, are minimal.

As described above, according to one feature of the invention, it is expedient if compressors and pumps of the plant are driven by electric motors whose electrical energy is supplied by the electric generator powered by the gas turbine. This results in substantial reduction of steam quantity to be condensed, and reduces the cooling water requirements for the plant.

The following two tables compare selected key data for furnace operation and operating means consumption of a conventional plant with the corresponding data of a plant employing the inventive process. The conventional plant used for comparison has a capacity of 250,000 jato ethylene from hydroconverter residue. The main compressors (crude gas, ethylene, propylene) and pumps (like feed water pumps, cooling water, quenching oil, etc.) are powered by steam turbines. The cracking furnaces with integrated waste heat are equipped with self-priming sidewall burners.

TABLE 1

| Consumption of Operating Means | | | | |
|---|---|---|---|---|
| Fuel requirement | Furnaces | MW | 251.9 | 204.8 |
| | Gas Turbines | MW | — | 41.2 |
| | Total | MW | 251.9 | 246.0 |
| High Pressure-1 Export | — | t/h | 41.8 | 69.3 |
| High Pressure-1 Import | — | t/h | — | — |
| BFW-Import | — | t/h | 81.8 | 110.0 |
| Heating Condensate Export | | t/h | 27.9 | 27.9 |
| Cooling Water Cycle | — | $M^3/h$ | 5.400 | 4.220 |

TABLE 1-continued

| Consumption of Operating Means | | | | |
|---|---|---|---|---|
| Electrical Power Required | — | kW | 1.685 | 1.202 |

TABLE 2

| Furnace Operation | | | |
|---|---|---|---|
| Fuel Requirement | MW | 251.9 | 204.8 |
| Combustion Air-Heat | MW | 0.0 | 37.8 |
| Total Heat Supplied | MW | 251.9 | 242.6 |
| Radiation Zone | % | 38.1 | 39.6 |
| Process | % | 61.2 | 63.6 |
| Total | % | 91.3 | 91.3 |
| Steam Production | t/h | 155.2 | 144.6 |
| Flue Gas Quantity | $Nm^3/h$ | 300.509 | 287.020 |
| BFW-Temperature, Furnace Inlet | °C. | 130 | 130 |
| Combustion Air Temperature | °C. | 15 | 400 |

The comparison of operating means cost and resultant economy of the two processes is determined by the cost of heat and the relationship between heating costs and steam valuation. Depending upon the value accorded to these two parameters, operating means costs of the inventive process can be lowered in an amount of up to 12% and more in comparison to the conventional process.

A plant operating according to the inventive concept, requires modifications over a conventional plant which result in additional investment costs (e.g. installation of a gas turbine with an electric generator, replacing turbines for cooling medium with electric motors, replacement of small turbines with corresponding motors, installation of fresh air blowers and an air preheater). However, based on the substantial savings in operating costs, the amortization period is short.

BRIEF DESCRIPTION OF THE DRAWING

The FIGURE is a schematic drawing of a plant operating according to the process of the invention.

DETAILED DESCRIPTION OF THE DRAWING

Referring to the figure, cracking furnace 1 is supplied with fuel via line 2 and is supplied with oxygen containing gas via line 3 for fuel combustion. In normal operation, the oxygen containing gas comprises two components. One component is the waste gas of a gas turbine 4 whose essential elements are air compressor 5, gas generator 6 and service turbine 7. The waste gas leaves the turbine via line 8 leading to air preheater 9.

The second component is the air which is drawn in via fresh air blower 10 and is passed to air preheater 9. In air preheater 9 the air is indirectly heated by steam which flows in heat exchanger elements 11 and then is subsequently mixed with the waste gas of the gas turbine. This mixture is then fed to line 3 leading to the cracking furnace.

The cracked gas formed in cracking furnace 1 leaves the cracking furnace via line 21. It is cooled in quench cooler 22 in heat exchange with pressurized water from steam pressure vessel 23 and is passed to an oil fractionation process not depicted. Vaporized water from the heat exchange is returned to steam pressure vessel 23. Steam is withdrawn from steam pressure vessel 23 via line 25, then is superheated in heat exchange with flue gases of cracking furnace 1, in heat exchanger 24, and is passed to steam header 26.

Via steam turbines 30, 31, 32 steam is withdrawn from this steam header, expanded, and, depending upon the pressure of the expanded steam, is fed respectively to high-pressure steam header 27, medium-pressure steam header 28 or low-pressure steam header 29. Turbine 30, for example, can drive the crude gas compressor, not depicted. The steam leaving turbine 30, having been expanded to condensation pressure, is condensed in condenser 34 and then is passed to feed water container 33, in which gas is extracted from the condensate.

The invention provides that steam can either be exported from the plant or imported into the plant by high-pressure steam header 27. Steam of the two steam headers 28, 29 is passed to heat sinks 35, such as a process steam generator or a column reheater, and is subsequently condensed. The condensate of these steam headers, as well as the condensate formed in heat exchanger 11 by heat exchange with the air to be preheated, is guided to feed water container 33. Feed water is withdrawn from the feed water container via line 36 and brought to the pressure of steam pressure vessel 23, then is heated within the steam system against condensing steam of various pressure stages (heat exchanger 37). The preheater feed water enters steam pressure vessel 23 via line 38.

The process of the invention uses forced air burners as burners for the cracking furnace or furnaces. In contrast, to the self-priming burners, forced air burners permit measurement of the air quantity which flows towards the burner and, therefore, the ability to keep surplus air to a low level. As there may be a change in the oxygen content of the gas mixture, which consists in the inventive process of gas turbine waste gases and air, the process provides for the measurement and regulation of the amount of oxygen, rather than the amount of air. Of primary consideration is the control of air to prevent a shortage of oxygen, with the heating means being a secondary consideration. To this end, each of the forced air burners is provided with an air supply and equipped with a valve device for quantity regulation.

The furnace exhaust temperature is monitored, and the oxygen quantity necessary to maintain the required heat output (pressure- and temperature-corrected) is preset by means of a flap valve. The amount of fuel possible, for a predetermined amount of excess oxygen, is added by means of a ratio distributor into which the Wobbe Index is entered as correcting value if fluctuations of the heating medium occur.

Line 3 for the gas mixture flowing towards the cracking furnace has pressure regulator 13 which acts upon a torque regulator for fresh air blower 10, if the pressure is too low. If pressure is too high in line 3, a portion of the gas mixture consisting of turbine waste gas and fresh air is passed off to the chimney via flap valve 14.

Moreover, line 3 has built-in temperature control 12, which acts upon regulating valve 39 in the steam line leading to heat exchanger 11. Preheating of the fresh air permits the maintenance of a constant temperature of the gas mixture consisting of gas turbine waste gas and fresh air, thereby avoiding adverse effects upon furnace operation, even in the event of fluctuations in gas turbine exhaust temperature.

An essential feature of the inventive process is that turbine 7 drives electric generator 15. The electric current generated in generator 15 serves to power motors 16, 17, for compressor 18, 19, in which, for example, ethylene and propylene are being compressed. In an identical manner, generator 15 supplies energy to power other compressors or pumps in the inventive plant for cracking hydrocarbons.

In summary, it can be stated that operating costs of an olefin plant can be reduced by employing a turbine for generator drive, and by reutilization of gas turbine waste gas, together with the preheated fresh air.

I claim:

1. A method for operating a plant for the cracking of hydrocarbons, comprising the steps of:

(a) passing hot waste gases from a gas turbine to an air preheater; and (b) passing air from a fresh air blower to the air preheater, whereby the waste gases are mixed with fresh air creating a mixture; and (c) heating said mixture in the preheater; and (d) passing the heated mixture to a cracking furnace; and (e) combusting said heated mixture and a fuel in the cracking furnace, whereby heat for cracking hydrocarbons is generated directly by the combustion and indirectly by the heated mixture.

2. The method of claim 1 where the step of heating further comprises the steps of: passing steam through heat exchange elements located in the preheater; and exchanging heat from steam with heat of the mixture, whereby said exchanging heats the mixture to a temperature which compensates for fluctuations in temperatures of the waste gases.

3. The method of claim 2 wherein the gas turbine comprises an air compressor, a gas generator and a service turbine.

4. The method of claim 3 further comprising the steps of: driving an electric generator with the gas turbine; passing electricity from the generator to electric motors; and driving compressors for ethylene and propylene with electricity generated by the electric motors.

5. The method of claim 4 wherein compensation for fluctuations in turbine waste gas temperatures is carried out by a temperature control acting in conjunction with a regulating valve located on a conduit communicating with the heat exchange elements and the preheater.

6. The method of claim 5 further comprising the steps of: forming cracked gas in the cracking furnace; passing the cracked gas to a quench cooler; passing cool cracked gases to an oil fractionation process.

7. The method of claim 6 where the step of cooling the cracked gas further comprises the steps of: passing pressurized water from a steam pressure vessel to the quench cooler; and exchanging heat from the pressurized water with the heat of the cracked gases; and flowing vaporized water from the heat exchange to the steam pressure vessel.

8. The method of claim 7 further comprising the steps of passing steam from the steam pressure vessel to heat exchangers within the cracking furnace; and exchanging heat from flu gases within the cracking furnace with the steam, whereby the steam is superheated; and flowing the superheated steam to a steam header.

9. The method of claim 8 further comprising the steps of passing steam from the steam header to steam turbines, whereby said turbines are made to work; and passing the steam from the turbines, said steam having been expanded to condensation pressure, to a condenser, whereby a condesate is formed; passing said condensate to a feedwater container; and extracting gas from said condensate.

10. The method of claim 9 where the step of passing steam from a steam turbine to a condenser further comprises the steps of: assessing pressure of the steam after said steam has expanded within the steam turbines; and passing high pressure steam to a high pressure steam header, passing medium pressure steam to a medium pressure steam header, and passing low pressure steam to a low pressure steam header.

11. The method of claim 10 further comprising the steps of exporting steam from a plant through the high pressure steam header.

12. The method of claim 11 further comprising the step of importing steam into the plant through the high pressure steam header.

13. The method of claim 12 where the step of passing steam to the condenser further comprises the steps of: passing steam from the medium pressure steam header and low pressure steam header to the condenser.

14. The method of claim 13 wherein the step of passing steam to the condenser is carried out by using heat sinks as the condenser.

15. The method of claim 14 wherein the heat sink is a process steam generator.

16. The method of claim 14 wherein the heat sink is a column reheater.

17. The method of claim 15 further comprising the steps of passing feed water from a feedwater container into various conduits of a steam system; and pressurizing said feedwater to a pressure existent in said steam pressure vessel; and exchanging heat from condensing steam with the heat of the pressurized feedwater; and passing said heated feedwater into said steam pressure vessel.

18. The method of claim 17 where the step of forming cracked gas is carried out using forced air burners as burners for the cracking furnace, wherein said forced air burners comprise a valve device for quantity regulation of an air supply.

19. A process for operating a plant for cracking hydrocarbons comprising, combusting a mixture of fuel and an oxygen containing gas in a cracking furnace to produce heat necessary for cracking the hydrocarbon fuel, whereby cracked gases are formed, cooling the cracked gases with first heat exchange means, combusting compressed air and fuel in a gas generator to produce an oxygen containing waste gas, expanding the waste gas in a turbine to drive electric generators that produce electricity, driving compressors used in the cracking process with the generated electricity, and feeding expanded hot waste gas from the gas turbine and preheated ambient air to the cracking furnace to provide a heated source of oxygen containing gas for combustion.

20. The process of claim 19 further comprising mixing the waste gas from the turbine with the air before feeding to the cracking furnace.

21. The process of claim 20 further comprising preheating the air in a preheater having second heat exchange means before mixing.

22. The process of claim 19 wherein the step of cooling the cracked gases comprises, feeding cracked gases through a quench cooler in heat exchange with pressurized water from a steam pressure vessel, feeding vaporized water generated from the heat exchange back to the steam pressure vessel, withdrawing steam from the pressure vessel and superheating with flue gases from the cracking furnace, and feeding superheated steam to a steam header.

23. The process of claim 22 further comprising expanding steam from the steam header in steam turbines connected to compressors, condensing the steam after expansion, and passing the condensed steam to a feed water container.

24. The process of claim 22 further comprising, importing steam from outside the plant through a second steam header, passing the imported steam to heat sinks for condensation and passing the condensed imported steam to a feed water container.

25. The process of claim 23 further comprising, passing water from the feed water container to the steam pressure vessel.

26. The process of claim 25 further comprising, using waste heat generator by the cracked gases to generate high pressure steam using compressors.

27. The process of claim 26 further comprising, preheating the air prior to mixing with the waste gas from the gas turbine in an air preheater.

28. In a process for producing cracked gases high in olefins by exposing hydrocarbons to high temperature in a cracking furnace, said plant requiring power to operate plural compressors an improved process comprises, combusting compressed air and fuel in a gas generator expanding oxygen containing waste gas from the gas generator in a gas turbine, feeding the expanded oxygen containing waste gas from the gas turbine, after mixing with air, to the cracking furnace, combusting the waste gas and air mixture, in a fuel in the cracking furnace to crack hydrocarbons rapidly cooling cracked gases after removing from the cracking furnace in a quenching system, whereby the cooled cracked gases are compressed, and generating electricity with a generator powered by the gas turbine using generated electricity to power plant compressors.

29. Process for operating a plant for the cracking of hydrocarbons, whereby the hydrocarbons are cracked in cracking furnaces, by the heat resulting from the combustion of a heating medium with an oxygen-containing gas, characterized in that the heating medium comprises an oxygen containing waste gas of a gas turbine which is mixed with air, the gas mixture being passed to the cracking furnace for combustion of the heating medium, whereby an electric generator is powered by the gas turbine, further characterized in that the compressors and pumps of the plant for cracking hydrocarbons are driven by electric motors which are supplied with electric motors which are supplied with electric energy by the electric generator powered by the gas turbine.

* * * * *

UNITED STATES PATENT AND TRADEMARK OFFICE

CERTIFICATE OF CORRECTION

PATENT NO. : 4,912,282

DATED March 27, 1990

INVENTOR(S) : Klaus Mikulla

It is certified that error appears in the above-identified patent and that said Letters Patent is hereby corrected as shown below:

On the title page, under item [19], "Klaus" should be --Mikulla"; and in item [75], "Mikulla Klaus" should be --Klaus Mikulla--.

Signed and Sealed this

Twenty-second Day of January, 1991

*Attest:*

HARRY F. MANBECK, JR.

*Attesting Officer*

*Commissioner of Patents and Trademarks*